US006095057A

United States Patent [19]

Corban

[11] Patent Number: 6,095,057

[45] Date of Patent: Aug. 1, 2000

[54] TRAY OR SHELF FOR SCISSOR AND AERIAL LIFTS

[75] Inventor: John E Corban, South Bend, Ind.

[73] Assignee: John E. Corban, South Bend, Ind.

[21] Appl. No.: 09/293,387

[22] Filed: Apr. 16, 1999

[51] Int. Cl.[7] ..... A47B 5/00

[52] U.S. Cl. ..... 108/42; 108/152

[58] Field of Search ..... 108/42, 46, 47, 108/152, 108, 134, 135; 182/129

[56] References Cited

U.S. PATENT DOCUMENTS

| | | | |
|---|---|---|---|
| 3,252,614 | 5/1966 | Evans | 108/152 X |
| 4,121,692 | 10/1978 | Morawski | 182/129 |
| 4,274,687 | 6/1981 | Bayles et al. | 108/152 X |
| 4,480,810 | 11/1984 | Hall | 182/129 X |
| 5,158,023 | 10/1992 | Allen | 108/42 |

*Primary Examiner*—Janet M. Wilkens

[57] ABSTRACT

A sturdy, pre-formed steel shelf for use on scissor and aerial lifts and of the type having a formed handrail channel (14) that supports the shelf on the handrail of the lift (26). The base of the shelf (10) contains tool holders (20) that allow the worker to easily locate his tools. In addition, the tray is designed to be quickly placed on and removed from the lift by the use of safety pin (22) and safety pin clip (24).

2 Claims, 3 Drawing Sheets

TRAY OR SHELF FOR SCISSOR AND AERIAL LIFTS

CROSS-REFERENCE TO RELATED APPLICATIONS

Not applicable.

FIELD OF INVENTION

This invention relates to trays or shelves that are attached to scissor and aerial lifts, specifically trays that would be used to hold materials and/or tools while on scissor and aerial lifts.

DESCRIPTION OF PRIOR ART

Lift manufacturers supply scissor and aerial lifts without a tray or shelf that would be used for the purpose of holding material/tools. Lifts are also rented and purchased without a tray or shelf. However, the worker or person using the lift or elevated platform needs a tray or shelf to put his material/tools upon while performing his job or task. Without a tray or shelf, the worker must lay his material/tools on the floor of the lift, or hold the material between his knees or in his hands.

Workers have rigged or attached boxes, wood, and other supports to the lifts in order to hold their material/tools. These are welded, bolted, or screwed to the railing of the lift which makes them non-moveable and not useful for the next job or worker. These also become "in the way" if a worker needs to work where the box is mounted. These also could be the wrong size for the next job or worker. This practice also damages the handrails with holes or welds left over after the box is moved or removed.

Although these boxes or supports are used, they are not commercially available. There is also considerable time and material involved in assembling and attaching these boxes to the lift. They are limited in size and construction by material on hand.

SUMMARY

In accordance with the present invention, a tray or shelf is bent from #16 gauge steel that attaches to the handrail of scissor and aerial lifts for the purpose of holding material/tools. The tray is finished with a white powder coating.

Objects and Advantages

Accordingly, besides the objects and advantages of the lift tray described in my above patent, several objects and advantages of the present invention are:

(a) to provide a tray that is built in a variety of sizes to accommodate most material;

(b) to provide a tray that is designed to be safe in the manner of attachment;

(c) to provide a tray which will keep material off of the floor of the lift which reduces tripping hazards and reduces the strain of bending down to pick up material/tools;

(d) to provide a tray that is designed to adequately support hand and small power tools, as well as necessary material;

(e) to provide a tray that is both moveable and removable in a matter of minutes;

(f) to provide a tray that is designed in different configurations to fit different lifts or work platforms;

(g) to provide a tray that can be manufactured at a nominal cost and provide years of good service;

(h) to provide a tray that can save labor hours to different construction trades or maintenance workers.

Figure 1:
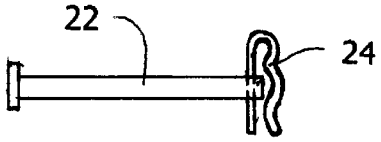
FIG. 1 shows the preferred fastener used with the support member of the present invention.
Figure 2:
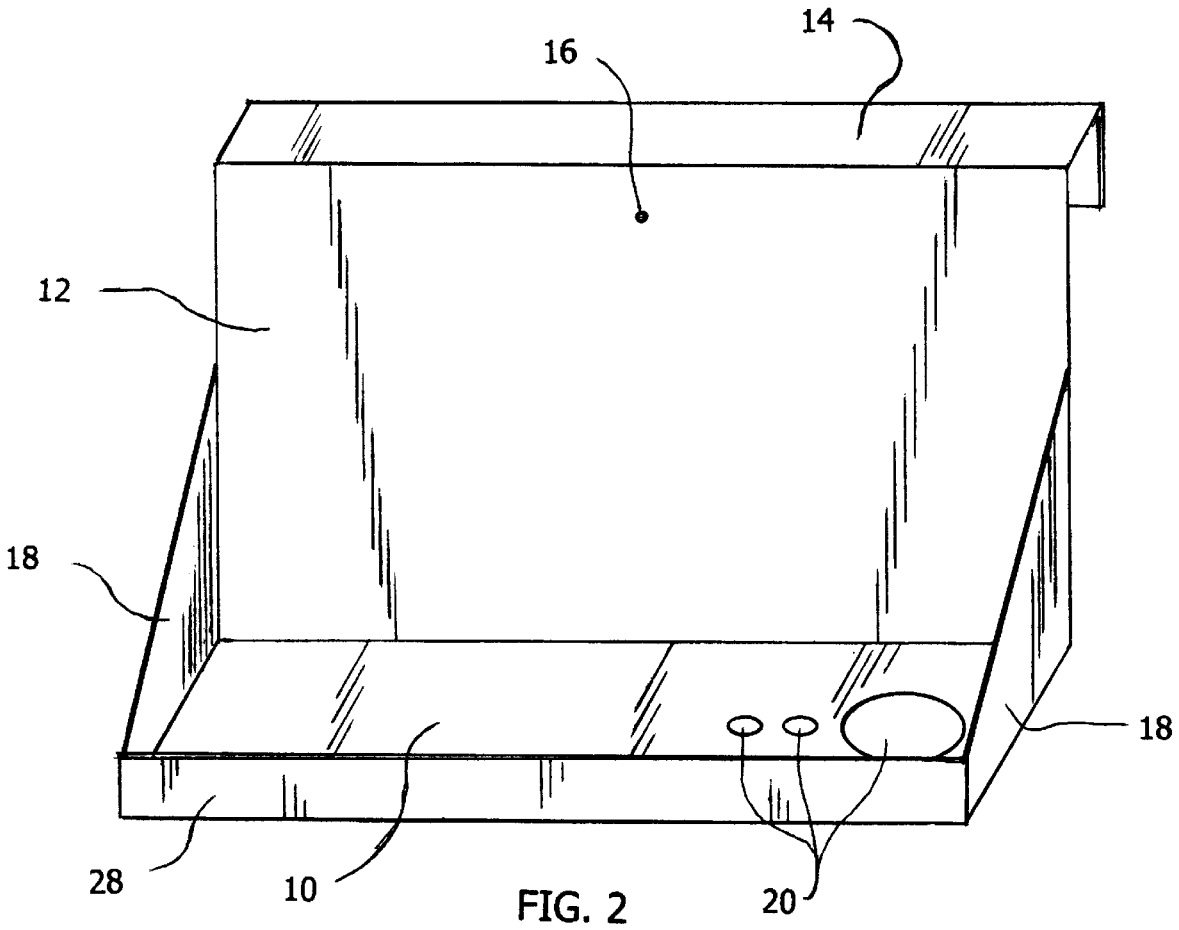
FIG. 2 shows a front view of the support member.
Figure 3:
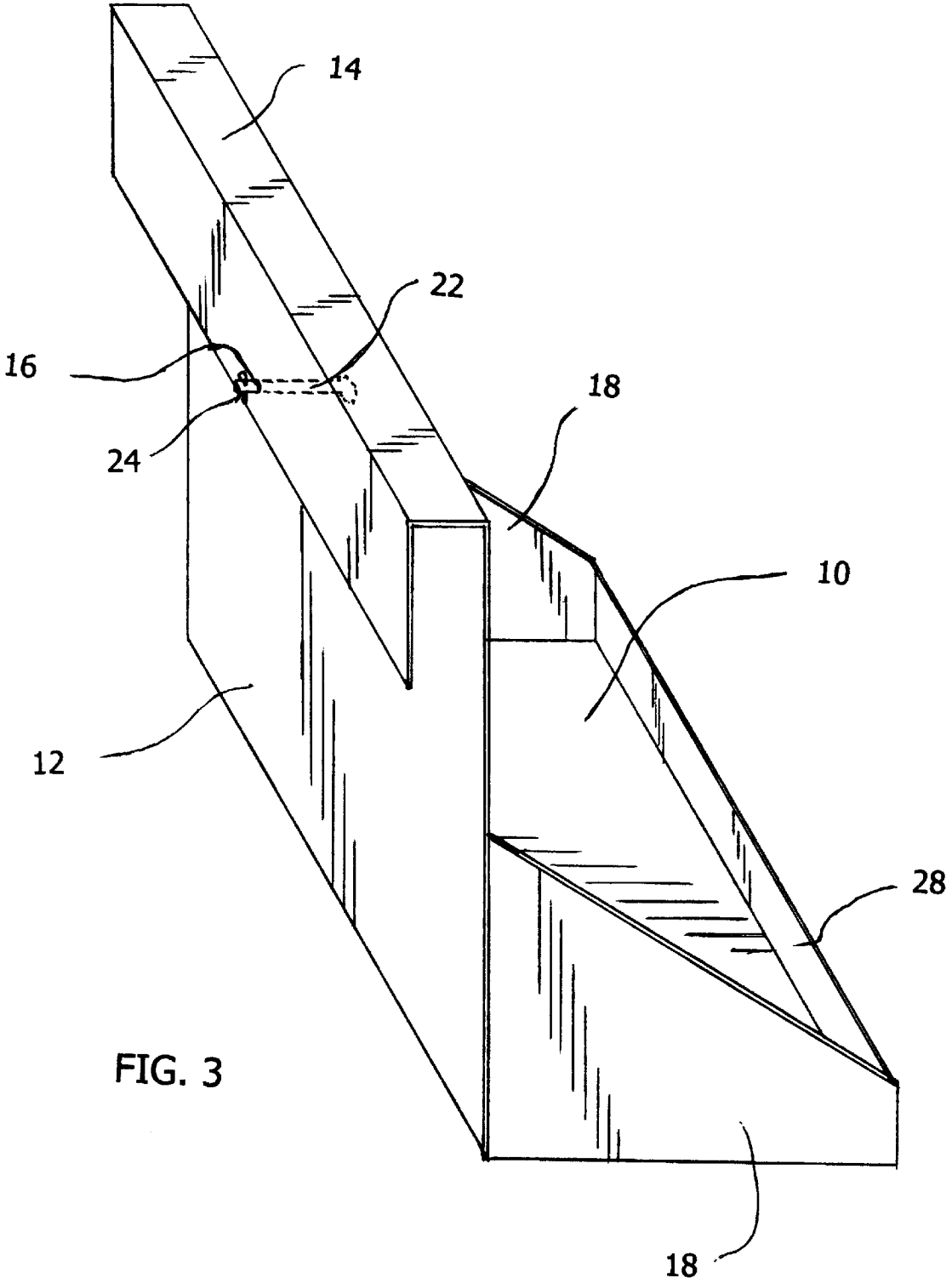
FIG. 3 shows a side view of the support member.

| Reference Numerals in Drawings | | | |
|---|---|---|---|
| 10 | base of shelf | 20 | tool holders |
| 12 | back support of shelf | 22 | safety pin |
| 14 | handrail channel | 24 | safety pin clip |
| 16 | safety pin location | 26 | handrail of the lift |
| 18 | end caps | | |

Figure 4:
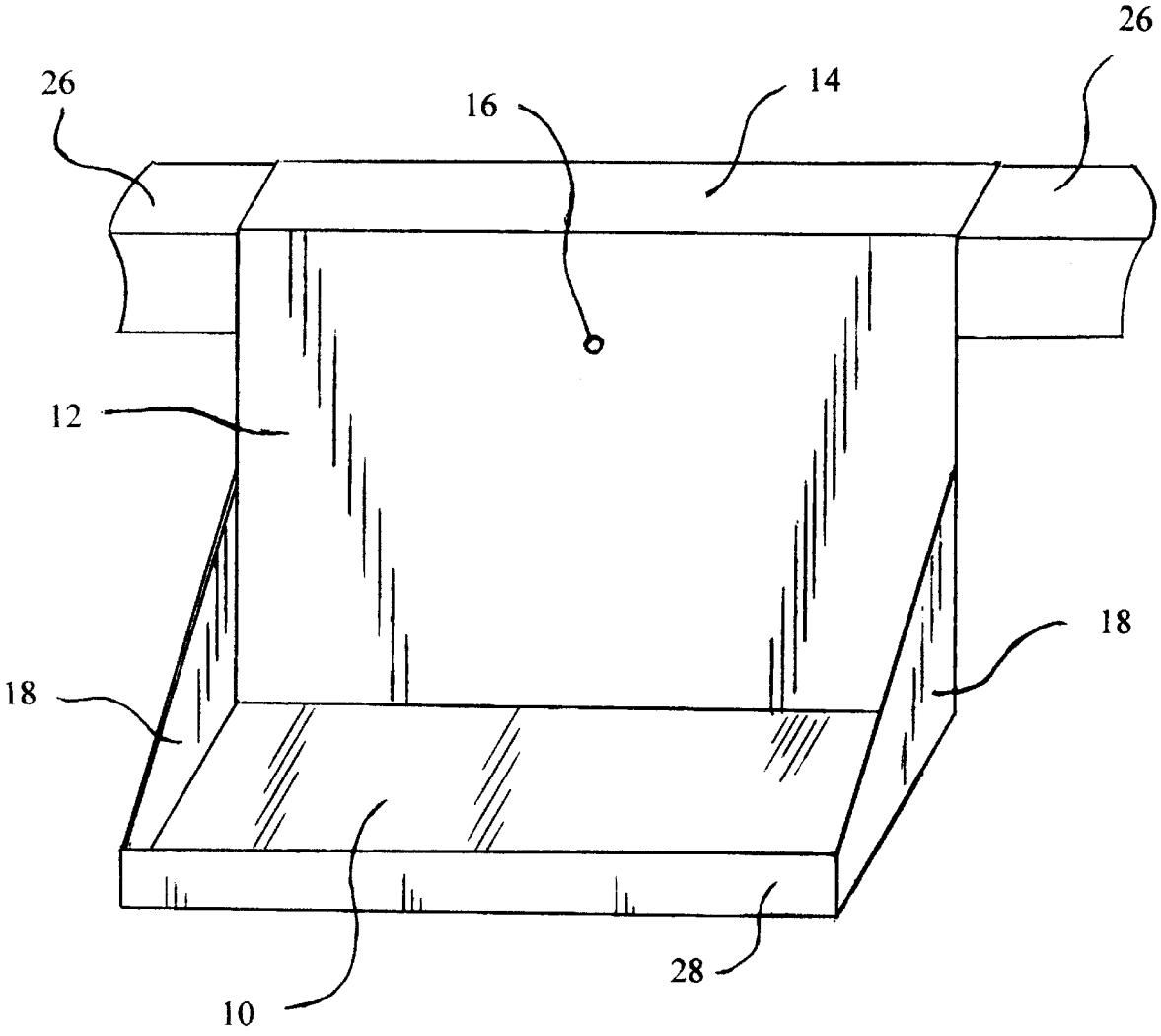
FIG. 4 shows the support member located on a handrail of a mechanical lift.

FIG. 4—Preferred Embodiment

The preferred embodiment of the present invention is FIG. 4 front view. The shelf is constructed of #16 gauge steel. The front lip is bent up at a 90° angle to keep material/tools on the shelf. The end caps 18 are welded to base of shelf 10 and back support of shelf 12. These keep material/tools on the shelf and give the shelf support. The back support of shelf 12 is bent up at a 90° angle from the base of the shelf 10 and continues up to create the handrail channel 14. The handrail channel 14 is two 90° bends bent back to back spaced far enough apart to receive the handrail of the lift 26. The shelf is placed on the handrail of the lift 26. The safety pin 22 is then placed through the pin location or holes 16 and safety pin clip 24 is inserted on safety pin 22. This is done to secure the shelf to the handrail of the lift 26. In the base of shelf 10, tool holders 20 are drilled and/or punched. This allows tools to be placed at a convenient work height and location. Other materials, such as a rigid plastic or fiberglass, could also be used to construct the shelf. If made from one of these other materials, the shelf would be cast or made with injection molding. The use of these materials would reduce the weight of the shelf and cost to make to shelf, but these require a large start up cost in making a mold.

Advantages

From the description above, a number of advantages of the scissor and aerial lift shelf become evident:

(a) Using a lift shelf will reduce the amount of material scattered about on the floor of the lift, which in turn reduces the risk of tripping hazards, limits material being knocked off the lift, and reduces lost material through better organization.

(b) With the use of a lift shelf, a worker has greater access to tools. This allows him to perform his job or task in less time, allows him to be a safer worker by leaving both hands free to hold on to work material or the handrail of the lift.

(c) A shelf made of other material, such as wood, will not hold up to construction conditions. Wood shelves need frequent repair or replacement.

(d) With a few lift shelves, a contractor can place the necessary number of shelves on any of his lifts and they can be readily removed when not needed.

(e) The lift shelf comes with or without the option of tool holders.

Operation—FIGS. 1, 2, 3, 4

The shelf is used by placing the handrail channel 14 on the handrail of a lift 26. Then material/tools are placed upon it. The installation is as follows:

Remove the safety pin 22 and safety pin clip 24 from the safety pin location 16. Then hang the shelf over the handrail of the lift. The safety pin 22 is reinserted through the safety pin location 16 inserting the safety pin clip 24 on the safety pin 22. With the safety pin 22 in place, the shelf can then be loaded with material. With the shelf properly attached to the handrail of the lift 26, it becomes a sturdy workspace at proper working height. The worker then can select any material/tools that has been placed upon the shelf. By using the shelf, material/tools are removed from the floor of the lift, keeping the floor clear for secure footing. Material can also be better organized and less material will be kicked off the lift accidentally. Tools that are left lying on the floor of the lift get damaged or lost. If they are placed on a tray or shelf, they can be easily located and handy to use.

The shelf can also be used to place items that have been disassembled for ease of replacement. When piping or fixtures are repaired, they can be placed upon the shelf ready to be replaced or reinstalled, if necessary. This shelf keeps parts from getting lost or damaged because the part is not placed on the floor of the lift.

When the shelf is no longer needed or is in the way, it can be removed by removing any material/tools, removing the safety pin clip 24 and safety pin 22 from the back support of the shelf 12, then lifting the shelf off the handrail of the lift 26. It can then be placed on the floor of the lift or completely removed from the lift.

Conclusion, Ramifications, and Scope

Accordingly, the reader will see that the lift shelf of this invention can be used to support, organize, and store material/tools while working on a scissor or aerial lift. It's use can create a safer work place by keeping material off the floor of the lift reducing tripping hazards and keeping material from being kicked off the lift. It's use can create a safer work place by not having to stoop or bend over to pick up material/tools. The ease of placement and removal reduces work hours by eliminating unnecessary wasted time building and attaching other material or boxes to the lift.

Although the description above contains much specificity, these should not be construed as limiting the scope of the invention, but as merely providing illustrations of the presently preferred embodiments of this invention. For example, other shapes or sizes could be used such as longer or shorter lengths or varying the shelf width. A corner shelf could be used. Other material, such as plastic or fiberglass, could be used to construct the shelf. A lighter grade of steel could be used.

Thus the appended claims and their legal equivalents should determine the scope of the invention rather than by the examples presented.

I claim:

1. A device for holding objects for a human being while on a mechanical lift, comprising:

a support member having a horizontal shelf, a front lip, a vertical back, two vertical end caps extending between the lip and back, and a handrail channel extending from the back and adapted to be attached on a handrail of the mechanical lift; and a fastener being insertable through corresponding holes in the back and channel upon attachment of the member on the handrail, so that when the member is attached to the handrail, the member is securely held thereon by the fastener.

2. The device of claim 1 wherein said shelf is perforated to hold tools in an accessible location.

* * * * *